US009533859B2

(12) United States Patent
Araki Yassuda

(10) Patent No.: US 9,533,859 B2
(45) Date of Patent: Jan. 3, 2017

(54) SUSPENSION ANCHORING IN AN ELEVATOR SYSTEM

(75) Inventor: Sergio Araki Yassuda, Sao Paulo (BR)

(73) Assignee: Inventio AG, Hergiswil (CH)

( * ) Notice: Subject to any disclaimer, the term of this patent is extended or adjusted under 35 U.S.C. 154(b) by 665 days.

(21) Appl. No.: 13/318,725

(22) PCT Filed: May 18, 2010

(86) PCT No.: PCT/EP2010/056820

§ 371 (c)(1),
(2), (4) Date: Feb. 15, 2012

(87) PCT Pub. No.: WO2010/136359

PCT Pub. Date: Dec. 2, 2010

(65) Prior Publication Data

US 2012/0132487 A1 May 31, 2012

(30) Foreign Application Priority Data

May 25, 2009 (EP) ..... 09161013

(51) Int. Cl.
*B66B 7/08* (2006.01)

(52) U.S. Cl.
CPC ..... *B66B 7/08* (2013.01)

(58) Field of Classification Search
CPC ..... B66B 7/06; B66B 7/08; B66B 7/085; B66B 11/0065; B66B 7/10
USPC ..... 187/411
See application file for complete search history.

(56) References Cited

U.S. PATENT DOCUMENTS

| | | | | |
|---|---|---|---|---|
| 2,089,143 | A * | 8/1937 | White | 187/412 |
| 5,421,433 | A * | 6/1995 | Yoo | 187/391 |
| 6,341,669 | B1 | 1/2002 | St. Pierre et al. | |
| 2004/0154876 | A1 * | 8/2004 | Choi | 187/412 |
| 2006/0175152 | A1 | 8/2006 | Fargo et al. | |

FOREIGN PATENT DOCUMENTS

| | | | | |
|---|---|---|---|---|
| EP | 1630119 | A1 | 3/2006 | |
| JP | H01121073 | U | 8/1989 | |
| JP | 6255945 | A | 9/1994 | |
| JP | 2006089259 | A | 4/2006 | |
| JP | 2007084195 | A | 4/2007 | |
| JP | 2008087903 | A | 4/2008 | |
| SU | 918236 | A1 * | 4/1982 | |
| WO | WO 2005016812 | A1 * | 2/2005 | 187/412 |

OTHER PUBLICATIONS

English Translation of Inventor names and reference numbers on p. 10 of JP 318725 U1.*

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator system has at least one elevator car and at least one counterweight connected by a suspension device, both of which can be counter-directionally displaced at at least one guide rail in an elevator shaft via a traction sheave of a drive. At least one pivotable suspension anchoring is adaptable to displacements of the suspension device according to a displacement angle wherein a rolling body moves on a holding plate.

20 Claims, 7 Drawing Sheets

State of the Art

State of the Art

SUSPENSION ANCHORING IN AN ELEVATOR SYSTEM

FIELD OF THE INVENTION

The present invention relates to an elevator installation, in which at least one elevator car and at least one counterweight are moved in opposite sense in an elevator shaft, wherein the at least one elevator car and the at least one counterweight are guided at guide rails and supported by way of support means. The present invention relates particularly to the fixed-position fastening of support means ends, a so-termed support means fastening.

BACKGROUND OF THE INVENTION

A support means fastening is usually arranged at a fixed structure (building part or brackets or similar supported at the guide rails) in that a support means end connection is held by a tie bar or tie rod supported at the fixed structure. A compression spring, which serves as length compensation for the support means, can be provided as support.

The support means end connection is, for example, a connection functioning on the wedge principle and can be a part of a stationary support means fastening or a part of a support means fastening arranged at the elevator car and/or part of a support means fastening arranged at a counterweight. The former is usually the case with a 2:1 cable guidance and the latter, for example, in the case of a 1:1 cable guidance.

In both 2:1 and 1:1 forms of cable guidance or, however, also in the case of forms of cable guidance in furtherance of the principle it can happen depending on the respective size of the elevator installation or arrangement of guide rails, drive pulley, elevator car or counterweight that the support means when describing the maximum travel of the elevator car or the counterweight from the deepest shaft position to the highest shaft position is deflected from the perpendicular or the vertical. It is also possible for an oblique guidance of the support means to be realized from the outset, for example because in the case of the so-termed rucksack suspension it is desired to utilize the horizontal force components of the oblique support means guidance as a force attracting the elevator car or the counterweight to the guide rails.

The deflection of the support means away from the perpendicular or the vertical, which fundamentally occurs with all forms of all suspension in which the support means fastenings, the outer diameter of the support rollers and the outer diameter of the drive pulley are not vertically aligned relative to one another, has the consequence that the support means at the support means end connection and the tie rod are buckled to greater or lesser extent during operation of the elevator installation depending on the height position of the elevator car or the counterweight.

This buckling stress in turn can over time represent an undesired loading or material fatiguing for the support means, which leads to a premature exchange of the support means, but at least to a requirement for checking and maintenance, or even to fracture of the support means.

In general, for avoidance of horizontally arising forces which manifest themselves as bending or shearing forces in a tie rod, pairs of washers are known in which a convexly formed side of one washer fits in a correspondingly concavely formed side of the other washer. However, it is disadvantageous with such solutions that the pivotability is limited to only a small deflection angle and is subject to high friction forces.

Fundamentally, in such solutions the undesired horizontally arising forces are, in fact, no longer accepted solely by the material of the tie rod or its bending resistance, but compensation is simply provided by the friction forces. The overall situation of the arising forces in the relationship thereof to one another is thus not satisfactorily solved. Lateral, i.e. horizontally acting, force components continue to arise. Co-pivotation or adaptation, which is as free as possible, to the deflection angle with simultaneous full transmission of the vertical holding force is thus not achieved.

Due to the high friction forces it can be observed in these solutions that only a dynamic adaptation takes place, i.e. when the elevator car or the counterweight moves during operation or the deflection angle just changes then the convex/concave washers adapt to the deflection. By contrast, in the static case, i.e. when the elevator car or the counterweight is stationary, due to the high level of friction between the convex and the concave surface of the washers no adaptation takes place.

Consequently, the smallest possible friction is ensured at this location in that lubricants are used and/or the surfaces are treated or special low-friction and self-lubricating synthetic materials are used. This in turn makes the solutions complicated and cost-intensive, although ultimately in terms of mechanical basic principle they always represent only a compromise.

Patent specification U.S. Pat. No. 6,341,669 B1 discloses, for avoidance of buckling stress and for producing a constant deflection angle of the support means at the two sides of the elevator car, a stationary, but pivotable support means fastening which is identical in terms of mechanical basic principle. A hemisphere or a shank in the form of a longitudinally bisected cylinder is in that case arranged in a correspondingly concavely shaped seat. This seat, in order to keep the friction as small as possible, is preferably made from a technical synthetic material, namely acetal plastics material of the company Dupont under the name Delrin (Registered Trade Mark).

SUMMARY OF THE INVENTION

An object of the present invention is to propose a pivotable support means fastening which is optimized not only with respect to the friction forces which arise, but also with respect to the pivot angle. In addition, it shall be distinguished by technical simplicity, a low need for maintenance, and cost efficiency.

Fulfillment of the object consists at the outset in the arrangement of a rollable body on a flat support surface of a mounting plate.

By the term "rollable body" there is to be understood in the following a full cylinder or, however, also only a tube having at least one bore through which the tie rod is guided, which is fastened in prolongation of the support means end connection. As also in the case of conventional support means fastenings, a compression spring is stressed between the end of the tie rod and the mounting plate.

However, according to the present invention the compression spring is preferably seated on a fixing sleeve at the upper side of the rollable body and the latter is not arranged in a concavely formed seat, but can roll freely on the flat support surface of the mounting plate.

The friction forces, which in the prior art solutions arise between a convex setting surface and a correspondingly concave receptacle, are thereby almost eliminated, merely a negligible contact friction of the rollable body on the support surface—termed rolling surface in the following—of the mounting plate remaining. This negligible contact friction no longer opposes a preferably smooth and progressively growing or progressively diminishing adjustment of the deflection angle. In addition, adjustment in static operation is thus made possible.

The contact friction is preferably low due to hard surfaces of the rollable body and the rolling surface, so that in advantageous manner additionally also merely negligible material wear occurs.

However, also lying within the scope of the disclosure of the present invention is a design variant in which straight surfaces are, for avoidance of lateral slipping movements of the rollable body on the rolling surface (and consequently contact of the tie rod with the inner edges of the bore of the mounting plate), provided with a desired high level of contact friction. Such surfaces can, for example, be realized by rubber-like materials or a corrugation or even a toothing. A corresponding rubber-like layer, be it at the rollable body or at the rolling surface or at both, offers—apart for avoidance of lateral slipping movements—also the further advantage that a sound bridge from the support means via the support means fastening and via the mounting plate arranged in stationary position at the building is interrupted.

Moreover, according to the invention the spacing or the constructional height of the bore for the tie rod is reduced by omission of the concave receptacle at the constructional level of the mounting plate itself. This advantageously allows in the mounting plate a bore which frees up a greater adjustment angle of the tie rod than in the case of conventional pivotable support means fastenings.

The bore in the mounting plate is preferably of conical form in that the bore at the rolling surface of the mounting plate has a diameter which is slightly larger than the outer diameter of the tie rod. The diameter of the bore is greater at the underside of the mounting plate, thus opposite the rolling surface. It is thereby possible to achieve adjustment angles which are significantly greater than in known solutions and, for example, in an angular range of plus or minus 0 to 30 degrees, preferably plus or minus 6 degrees. In principle, higher adjustment angles for elevator installations with large transport heights are advantageous, as well as for elevator installations which do not have an engine room and in which the elevator car or the counterweight can be moved with respect to its height as close as possible to the stationary support means fastening or as close as possible to the drive pulley.

The fact that the bore at the upper side of the mounting plate, i.e. at the rolling surface for the rollable body, is only slightly larger than the outer diameter of the tie rod provides an advantage in the mounting of the support means fastening. In particular, it is no longer necessary, as in the case of conventional support means fastenings, to seek a central setting position and to centrally align the convex setting surface in the concave receptacle, since the support means fastening according to the invention is quasi self-centering.

A preferred higher stability of the flanks of the bore at the rolling surface of the mounting plate can be achieved if the bore has at least two stepped concentrically increasing individual bores.

A further preferred design variant of a support means fastening provides in the mounting plate, instead of a round bore, a slot which is arranged with its longitudinal direction in the direction of deflection of the support means. An unobstructed pivot movement of the tie rod is thereby ensured and almost any pivot angle can be realized. The constructional height of the mounting in this design variant is of no concern with respect to attainment of a wide adjustment angle. Rather, it can be high in favor of stability of the mounting plate.

A further design variant according to the invention provides that the rolling surface of the rollable body in cross-section does not have a round sectional profile, but has a sectional profile flattened around the central position. This flattened sectional contour preferably has the form of a parabola which is flattened by way of its power and/or by way of a fraction quotient. Expressed in simple terms, in accordance with this design variant the support means fastening according to the invention develops, like a tumbler, a force which urges it back into the central position and which is greater the more the deflecting angle increases. In this manner an adjustment possibility of the support means fastening is realized, by means of which small adjustments about the central position can take place unhindered, but as soon as the deflection angle threatens to adopt a maximum size which loads the tie rod with shear forces the described rounding of the rollable body acts in opposition thereto.

The described rounding of the rollable body thus also counteracts a lateral slipping away or lateral tipping away of the pivotable support means fastening. The same can also be achieved in accordance with the invention—in combination with the flattened rounding or, however, also in combination with the previously disclosed concentric rounding—by abutments which are formed appropriately to requirements at the flanks of the rounding.

A further design variant of a support means fastening according to the invention is based on the assumption that a compression spring in the form of a helical spring does not inherently build up optimal lateral holding forces. Moreover, the compression spring on the one hand has to surround the tie rod with play so that it can still freely compress or relax. On the other hand, due to the law of levers the deflection movement is initiated by the longest lever, thus by the upper end of the tie rod. This upper end of the tie rod exerts, in the case of deflection of the support means, a pressure on one side of the compression spring and this side of the compression spring in turn initiates the rolling motion of the rollable body. This transmission of pressure is that force which the co-pivotation of the support means fastening produces in correspondence with the deflection and in certain circumstances takes place only after the middle coils of the compression spring have placed themselves against the tie rod. This transmission of pressure has in every case, inaccuracies due to a state of the compression spring compressed to a greater or lesser extent and due to the constrained mounting of the compression spring with play around the tie rod as well as the inherently poor lateral stability of compression springs.

A significantly higher lateral stability than compression springs in the form of helical springs is, thereagainst, possessed by gas compression springs or gas springs. Modern gas compression springs, such as, for example, of the company Bansback easylift GmbH, of Lorch, Germany, or, for example, those of the company Stabilus of Koblenz, Germany, are, apart from the high lateral stability, additionally advantageously usable for high loads (up to 10,500 N) with simultaneously shorter spring travels—notwithstanding identical spring rates—and thus with smaller constructional heights.

The gas compression spring can, in quasi analogous manner to the previously disclosed design variant with a helical compression spring, be arranged in a hollow tie rod. A preferred design variant of a pivotable support means fastening with a gas compression spring provides, however, that the support means is directly fastenable by its support means end connection to the piston rod of the gas compression spring, preferably rotatably in a pivot eye. The cylinder of the gas compression spring is supported directly on the upper side of the rollable body, which optionally also can be flattened. In this manner a pivotable support means fastening is realized which is distinguished by only three components and by a direct and play-free transmission of the deflection movement of the support means to the pivot movement of the support means fastening.

A further advantage of this variant of embodiment of a pivotable support means fastening with a gas compression spring is that the point of force action of the support means fastening for the support means is lower than in the case of helical compression springs, in which the overall length of the helical compression spring has to be, for example, held by a nut and thus the point of force action at this nut lies at the end of the tie rod. The lower point of force action of a gas compression spring advantageously manifests itself in a lower constructional height—which is compatible with the concept and construction of elevator installations without engine rooms—as well as in smaller adjustment angles and smaller tipping and buckling loads.

This last-described design variant can optionally still be optimized in that the cylinder of the gas compression spring directly forms the rolling surface according to the invention and thus a separate rollable body is no longer required. This design variant of a pivotable support means fastening with a gas compression spring thus consists only of the gas compression spring supported on the mounting plate, thus merely of two components.

However, also lying within the scope of the disclosure of the present application is a particularly simple and correspondingly economic further design variant according to the invention, which in fact dispenses with a force storage element. In this regard, the tie rod is guided through a rigid or also flexible support sleeve which rests on the rollable body. The tie rod can form a head which in turn rests on the support sleeve or, according to a more simplified further design variant according to the invention, directly on the rollable body. In principle, the head of the tie rod can also integrate the rollable body in that the underside of the tie rod head directly forms the rollable body rolling surfaces.

As already mentioned above, the described design variants of pivotable support means fastenings according to the invention are suitable not only for stationary support means fastenings, but also for fastenings of a support means end connection to the elevator car and/or to the counterweight. Combinations thereof are possible, for example in the case of an elevator installation in which a 2:1 cable guidance at the counterweight and a 1:1 cable guidance at the elevator car are provided. Thus, an elevator installation would then reveal not only at least one pivotable support means fastening according to the invention at at least one stationary fastening point, but also at least one pivotable support means fastening according to the invention at at least one fastening point of the elevator car.

The pivotable support means fastenings according to the invention can be realized individually, but also—with individual mounting plates and individual rollable bodies or, however, also with integral mounting plates and integral rollable bodies—can be provided for several support means which, for example, are guided in parallel.

DESCRIPTION OF THE DRAWINGS

The invention is explained in more detail symbolically and by way of way of example on the basis of figures. The figures are described conjunctively and in general. The same reference numerals signify the same components and reference numerals with different indices indicate functionally equivalent or similar components.

In that case.

DETAILED DESCRIPTION OF THE INVENTION

Figure 1:
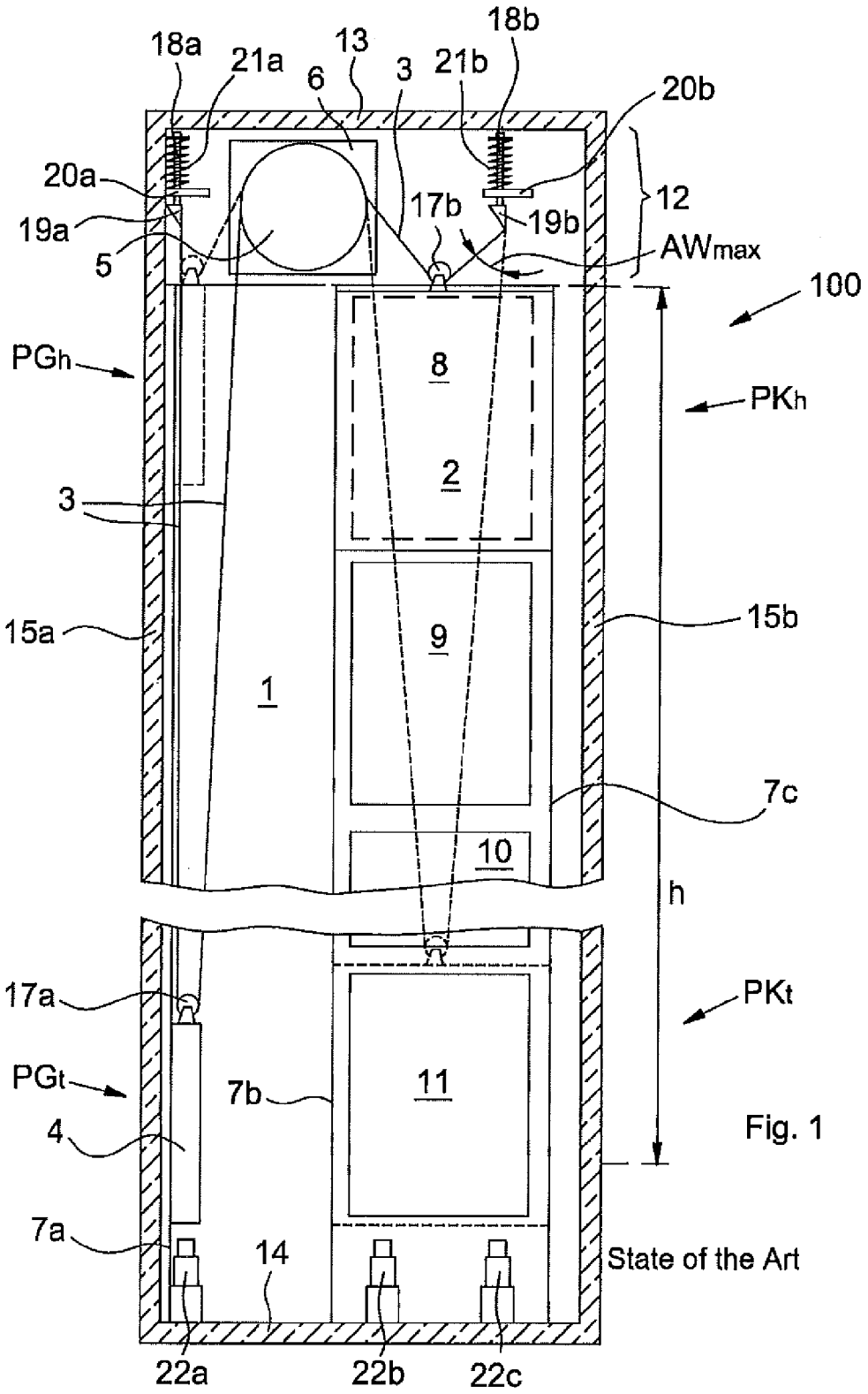
FIG. 1 shows a schematic illustration of an elevator installation according to the prior art with a 2:1 cable guidance for an elevator car and a counterweight.

FIG. 1 shows an elevator installation 100 such as is known from the prior art. An elevator car 2 is arranged to be movable in an elevator shaft 1 and is connected by way of a support means 3 with a movable counterweight 4. During operation of the elevator installation 100 the support means 3 is driven by a drive pulley 5 of a drive unit 6, which are arranged in the uppermost region of the elevator shaft in an engine room 12. The elevator car 2 and the counterweight 4 are guided by means of guide rails 7*a* or 7*b* and 7*c* extending over the shaft height.

The elevator car 2 can serve an uppermost floor 8, further floors 9 and 10 and a lowermost floor 11 over a transport height h. The elevator shaft 1 is formed from shaft side walls 15*a* and 15*b*, a shaft ceiling 13 and a shaft floor 14, on which a shaft floor buffer 22*a* for the counterweight 4 and two shaft floor buffers 22*b* and 22*c* for the elevator car 2 are arranged.

The support means 3 is fastened in stationary position at the shaft ceiling 13 or in stationary position at the shaft side wall 15*a* and led parallelly to the shaft side wall 15*a* to a support roller 17*a* for the counterweight 4. From here in turn the support means 3 is led back over the drive pulley 5, further to a support roller 17*b* for the elevator car 2 and to a second stationary fastening at the shaft ceiling 13 or at the shaft side wall 15*b*.

In the stationary fastenings the support means 3 is respectively fastened by a support means end connection 19*a* or 19*b* to a tie rod 18*a* or 18*b*. The tie rods 18*a* and 18*b* are—each loaded by a respective compression spring 21*a* or 21*b*—respectively supported on a mounting plate 20*a* or 20*b* arranged in stationary position. The mounting plates 20*a* and 20*b* are, for example, arranged at the shaft side walls 15*a* and 15*b*, at the shaft ceiling 13, at at least one guide rail 7*a*, 7*b*, 7*c* or at a drive bracket (not illustrated in more detail).

The counterweight 4 is illustrated by a solid line in a lowermost shaft position $PG_t$ and correspondingly the elevator car 2 in a highest shaft position $PK_h$. The counterweight 4 is shown in dashed lines in a highest shaft position $PG_h$ and the elevator car 2 in a lowermost shaft position $PK_t$. Particularly in the case of stationary fastening of the section, which is at the car side, of the support means 3 the lowermost shaft position $PK_t$ of the elevator car 2 and the highest shaft position $PK_h$ of the elevator car 2 mean that the support means 3 forms a maximum deflection angle $AW_{max}$.

Figure 2:
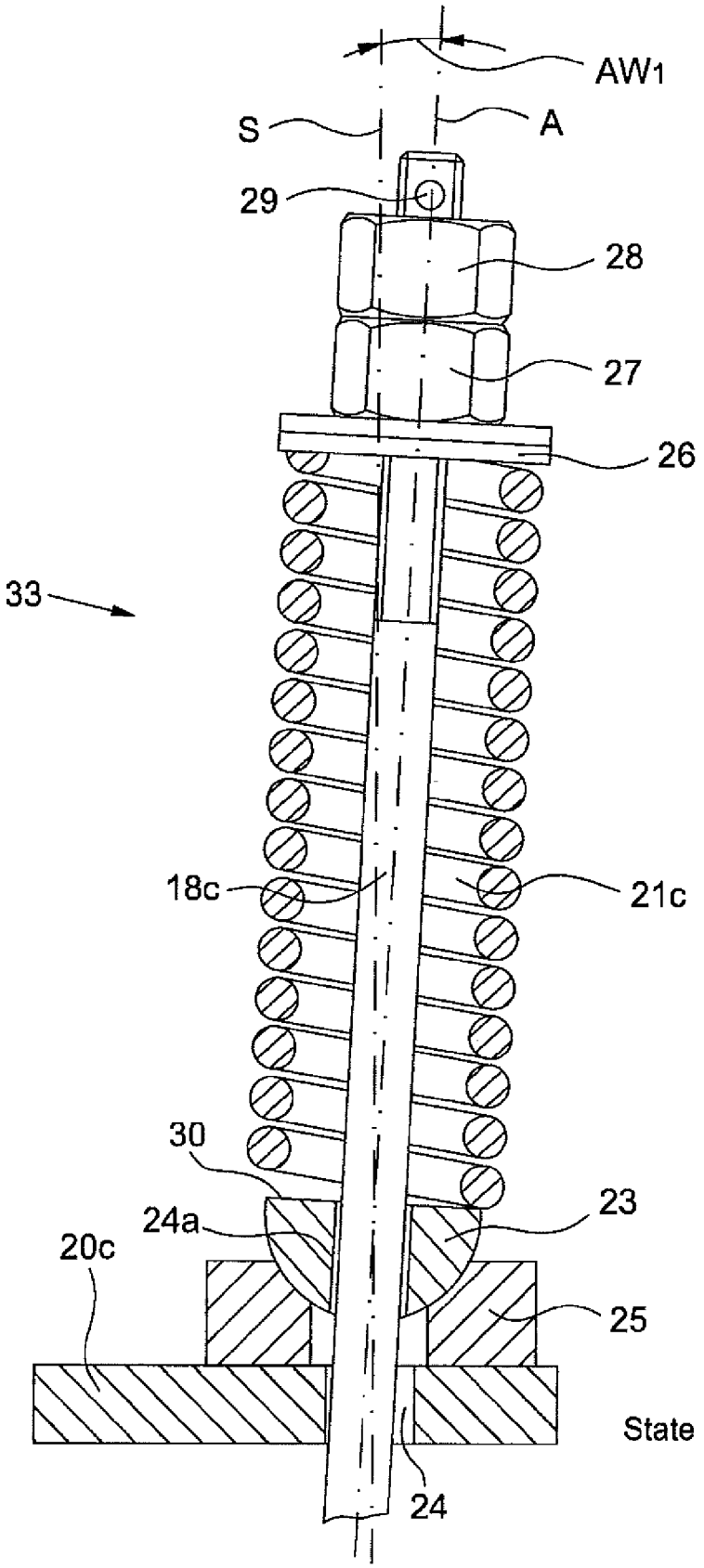
FIG. 2 shows a schematic detail illustration of a pivotable support means fastening according to the prior art.

FIG. 2 schematically shows a pivotable support means fastening 33 known from the prior art. A support means end connection (not illustrated) is connected with a tie rod 18*c* which is led through a bore 24 in a mounting plate 20*c*, further through a further bore 24*a* in a hemisphere 23 and through the coils of a helical compression spring 21*c*. The helical compression spring 21*c* is fixed by a washer 26, a nut 27, a lock nut 28 and a cotter pin 29 against a support surface 30 of the hemisphere 23. The hemisphere 23 is seated in a concavely shaped seat 25. Pivotation of the support means fastening 33 in correspondence with a deflection angle $AW_1$ between a perpendicular S and an axis A of the tie rod 18*c* is subject on the one hand to high friction forces between the surface of the hemisphere 23 and the concave surface of the seat 25 and on the other hand is limited by contact of the tie rod 18*c* with the flanks of the bore 24.

Figure 3A:
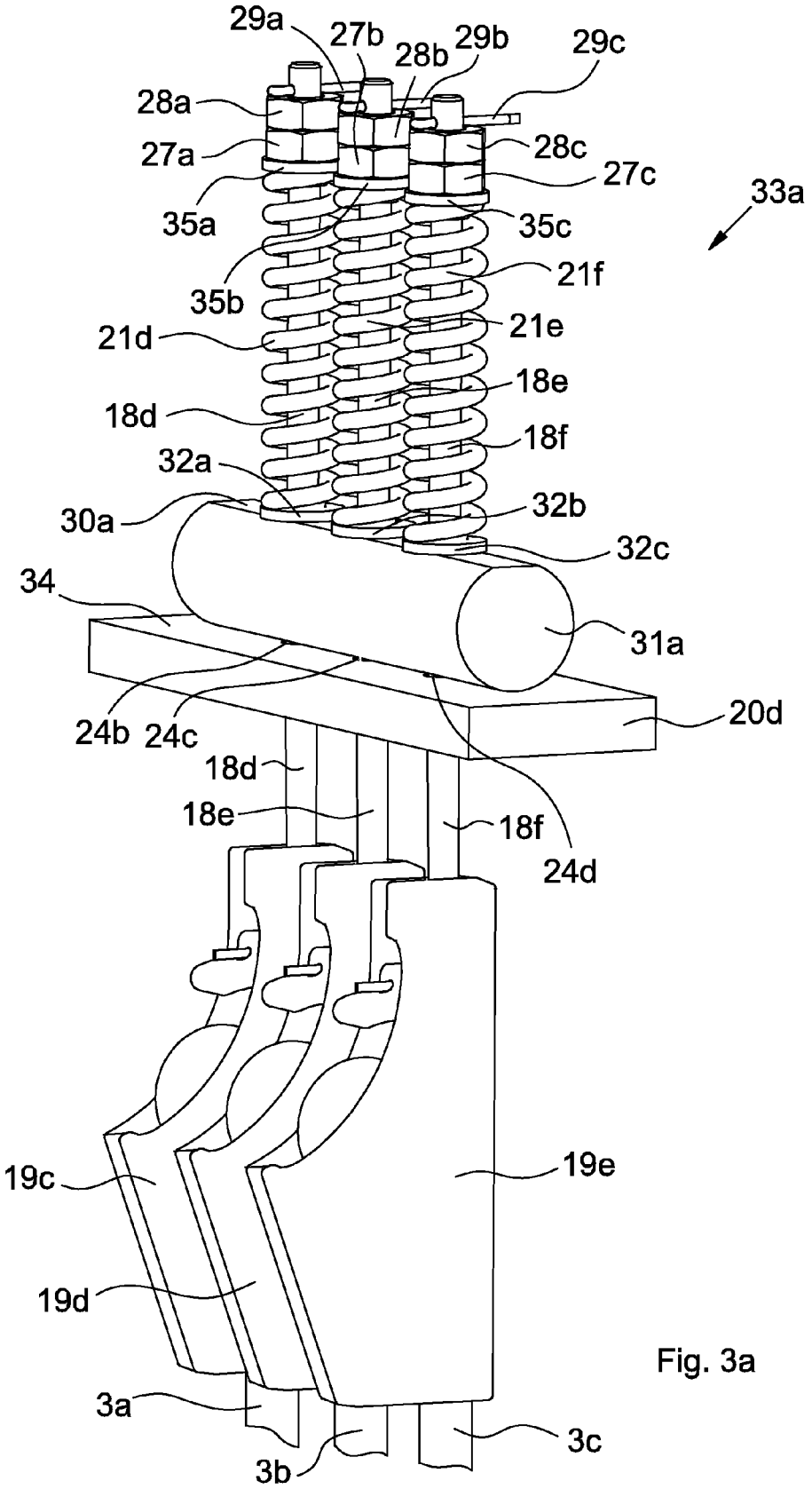
FIG. 3*a* shows a schematic detail illustration of a pivotable support means fastening according to the invention for three support means guided in parallel.

A pivotable support means 33*a* according to the invention for three parallelly guided support means 3*a*-3*c* is illustrated in perspective view in FIG. 3*a*. The three support means 3*a*-3*c* are respectively fastened by support means end connections 19*c*-19*e* to respective tie rods 18*d*-18*f*, which are led through bores 24*b*-24*d* in a mounting plate 20*d*, which is arranged in stationary position, and corresponding bores (not illustrated) in a rollable body 31*a*.

Deflection movements of the support means 3*a*-3*c* or of the support means end connections 19*c*-19*e* lead to pivot movement of the tie rods 18*d*-18*f* and this pivot movement in turn leads to rolling of the rollable body 31*a* on a flat rolling surface 34 of the mounting plate 20*d*.

The rollable body 31*a* additionally has a support surface 30*a* for lower fixing sleeves 32*a*-32*c* for respective helical compression springs 21*d*-21*f*, which in turn are each mounted by means of a respective upper fixing sleeve 35*a*-35*c*, nut 27*a*-27*c*, lock nut 28*a*-28*c* and split pin 29*a*-29*c* under bias.

Figure 3B:
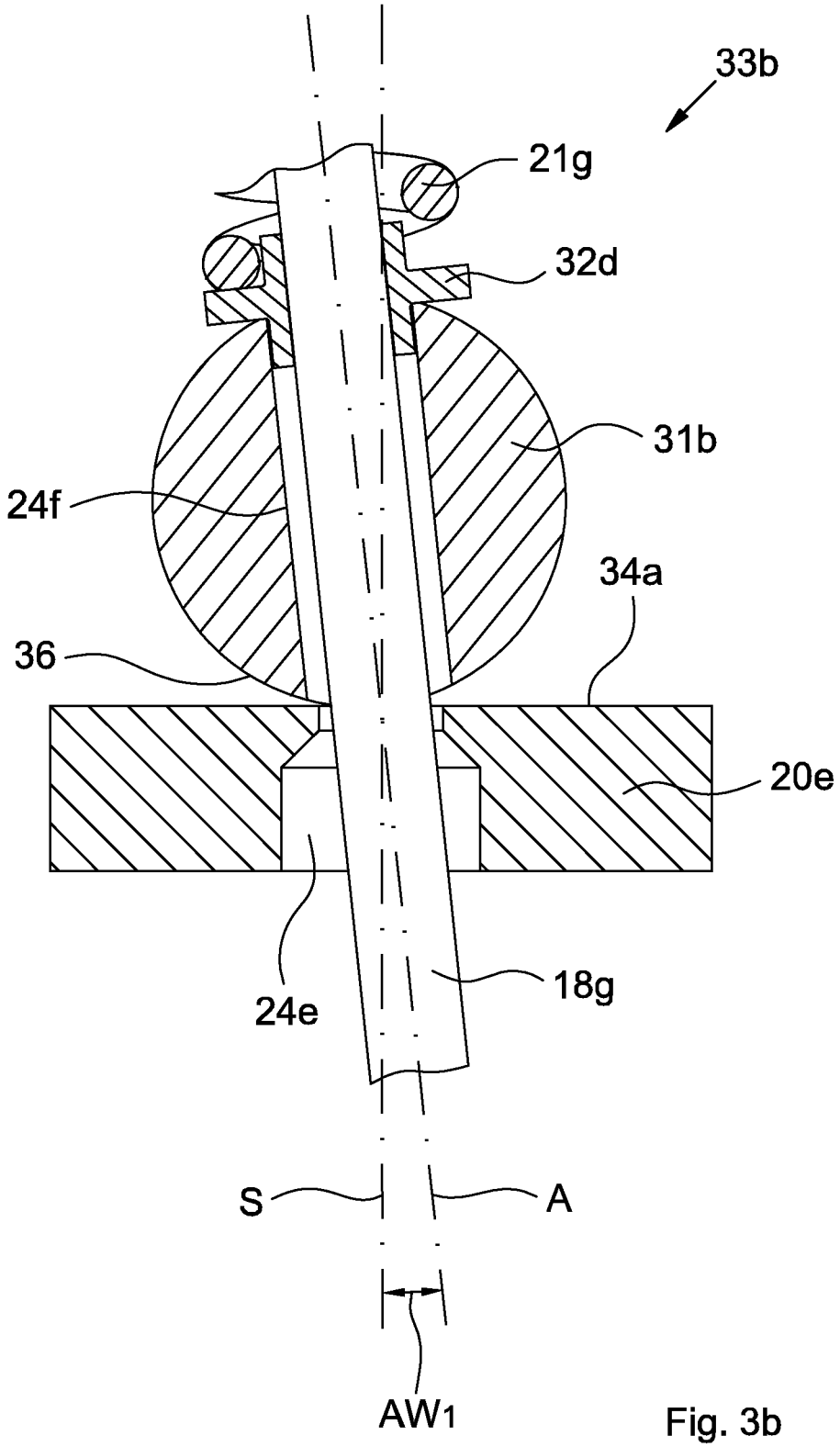
FIG. 3*b* shows a schematic and sectional detail illustration of a slightly different, but identical in principle, design variant of a pivotable support means fastening according to the invention.

FIG. 3*b* shows a schematic and sectional detail illustration of a pivotable support means fastening 33*b* according to the invention which is pivoted through the deflection angle $AW_1$ formed between the perpendicular S and the axis A of a tie rod 18*g*. The tie rod 18*g* is led through a bore 24*e* in a mounting plate 20*e* and through a further bore 24*f* in a rollable body 31*b*.

The bore 24*e* in the mounting plate 20*e* consists of two individual bores with different diameters so that the tie rod 18*g* can describe larger adjustment angles without hitting the flanks of the bore 24*e*.

By contrast to the rollable body 31*a* of FIG. 3*a* the rollable body 31*b* does not have a support surface for a lower fixing sleeve 32*d* or for a helical compression spring 21*g*. However, the rollable body 31*b* has a rollable body rolling surface 36 which in the case of pivot movements of the support means fastening 33*b* rolls on a rolling surface 34*a* of the mounting plate 20*e*.

The lower fixing sleeve 32*d* can optionally also be so designed that the lowermost diameter thereof below the collar embraces the tie rod 18*g* along the entire length of the bore 24*f*, preferably by means of a clearance fit which allows movement of the tie rod 18*g* along the axis A thereof, but frees as little as possible lateral movement transversely to the axis A.

Figure 4A:
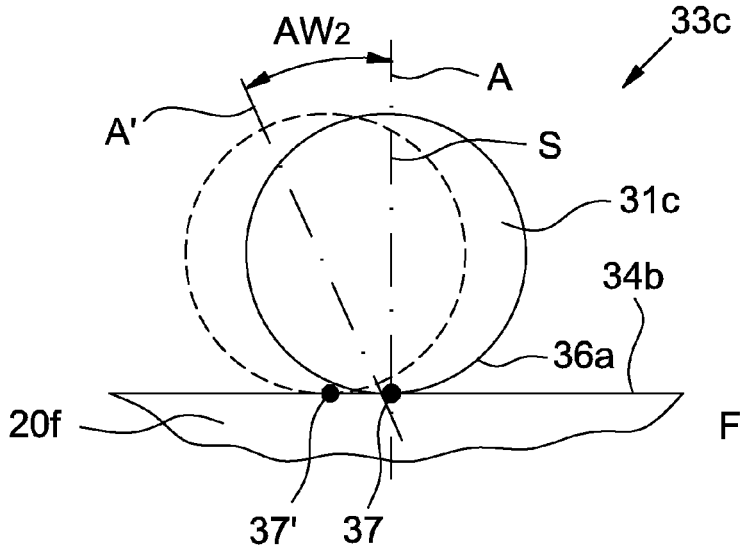
FIG. 4*a* shows a schematic illustration of a rollable body according to the invention.

FIG. 4*a* schematically shows in partly sectional detail illustration the functioning of a support means fasting 33*c* according to the invention or of a rollable body 31*c* according to the invention with a concentric round rollable body rolling surface 36*a* during rolling on a flat rolling surface 34*b* of a mounting plate 20*f*. The rollable body 31*c* is illustrated by solid line in a vertical position in which the perpendicular S and the axis A coincide. The rollable body 31*c* thus stands at a contact point 37. As soon as a pivot movement in correspondence with a deflection angle $AW_2$ of, preferably, 6 degrees takes place the rollable body 31*c* adopts a position which is illustrated by dashed lines. In this new position of the rollable body 31*c* the rollable body 31*c* stands at a new contact point 37' shifted to the left. It is apparent that a pivoted axis A' of its intersection point with the line representing the rolling surface 34*b* of the mounting plate 20*f* has hardly shifted. This is an indication of the fact that transmission of the holding force for the support means along the axis A' is also ensured in this position and a possible restoring moment remains negligibly small.

Figure 4B:
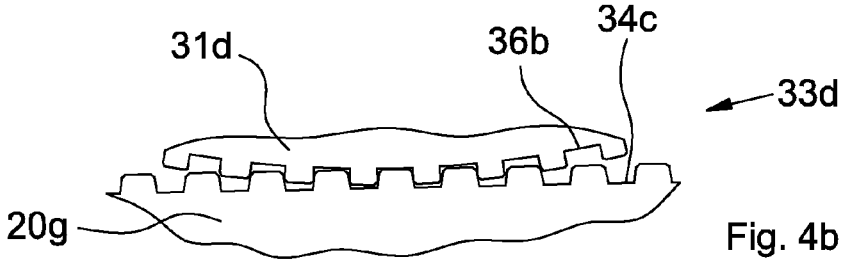
FIG. 4*b* shows a schematic illustration of a design variant of the rollable body according to the invention with a toothing.

A schematic sectional detail illustration of a design variant according to the invention of a pivotable support means fastening 33*d* is shown in FIG. 4*b*, which in favor of a pivotability of significantly more than 6 degrees has an interengaging toothing, which imparts lateral stability, at a rollable body rolling surface 36*b* of a rollable body 31*d* and at the same time at a rolling surface 34*c* of a mounting plate 20*g*.

Figure 4C:
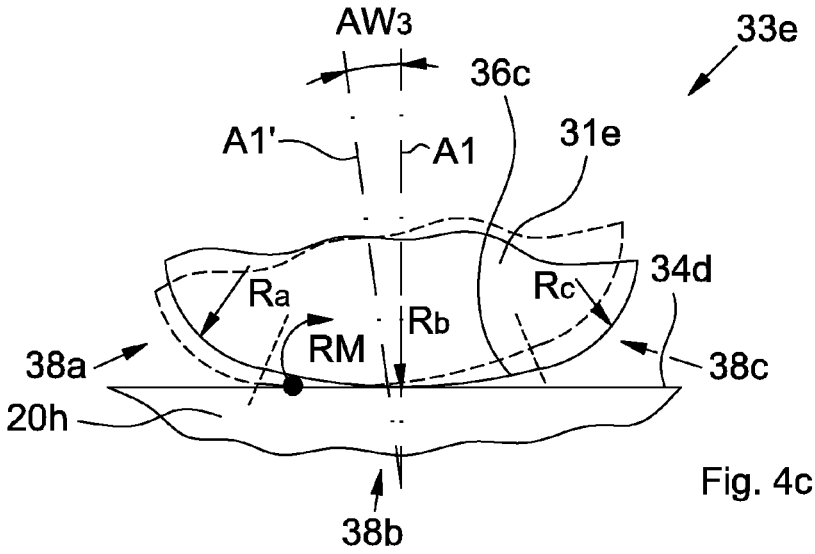
FIG. 4*c* shows a schematic illustration of a further design variant of the rollable body according to the invention.

FIG. 4*c* schematically shows in a sectional detail illustration a further design variant of a pivotable support means fastening 33*e* according to the invention. This design variant is distinguished by the fact that supported on a rolling surface 34*d*, which as before in FIGS. 3*a*, 3*b* and 4*a* is flat, of a mounting plate 20*h* is a rollable body 31*e* of which the rollable body rolling surface 36*c* is not concentrically round, but flattened centrally, i.e. on both sides about an axis A1. In other words, the rollable body rolling surface 36*c* forms a central section 38*b* with a radius Rb which is greater than the radii Ra and Re of two sections 38*a* and 38*c*. The latter sections 38*a* and 38*c* flank the central section 38*b* on both sides and seamlessly merge into the curvature of the central section 38*b*. The two lateral sections 38*a* and 38*c* quasi represent two shoulders which, as illustrated by dashed lines, on attainment of a deflection angle $AW_3$ towards an axis A1' act with a progressively increasing restoring moment RM in the direction of the original alignment of the support means fastening 33*e*.

An exemplifying mathematical function which illustrates the sectional profile of the rollable body rolling surface 36*c* according to the invention is a parabola which is compressed by way of its power and/or a fraction quotient. Thus, a mathematical function is, for example, $f_{(x)}=a\ x^n$, wherein $0<a<1$ and n is an even number. Thus, for example $f_{(x)}=0.1\ x^2$ or $f_{(x)}=0.5\ x^4$.

Figure 5:
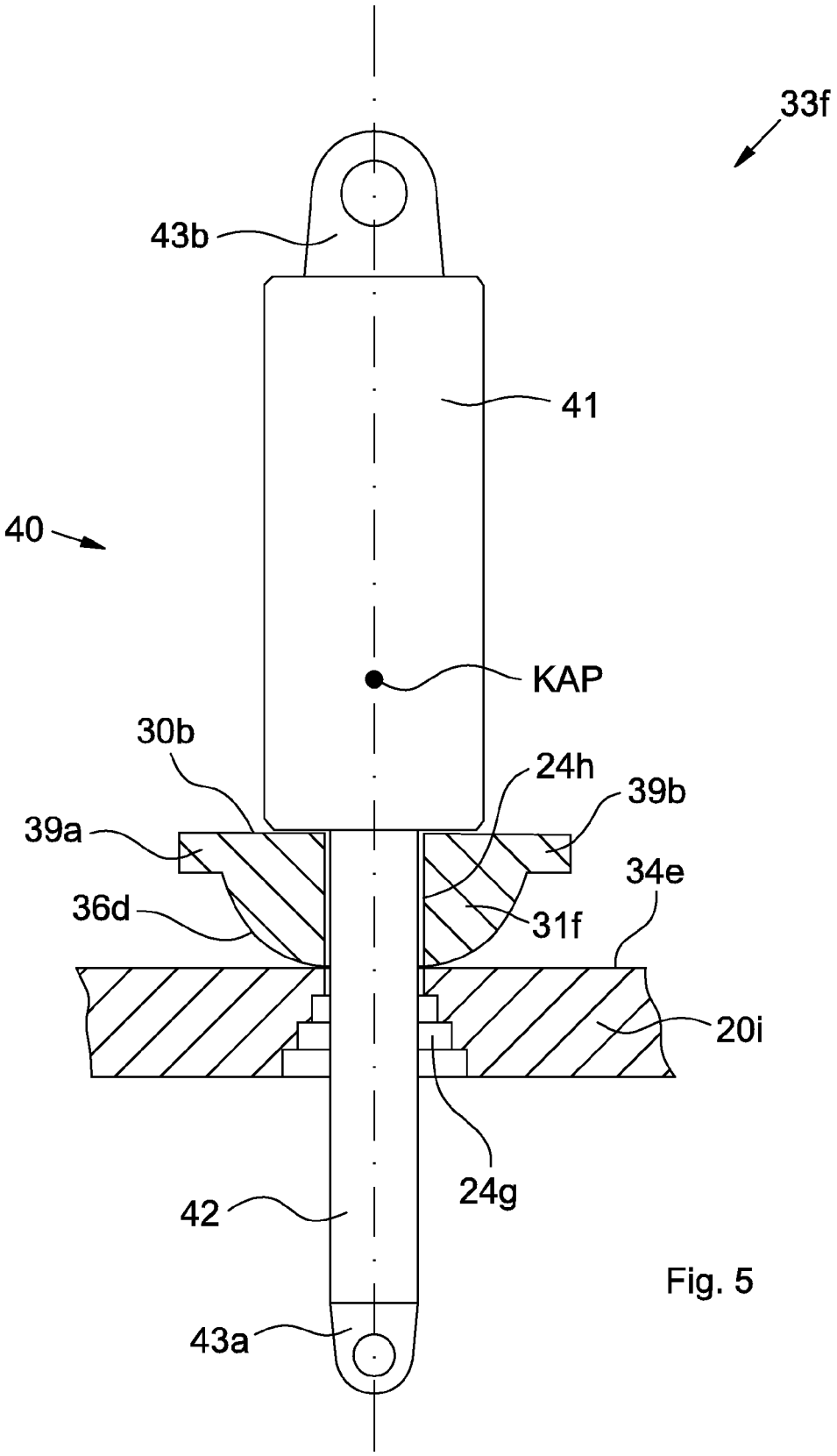
FIG. 5 shows a schematic illustration of a further design variant of a pivotable support means fastening according to the invention with a gas compression spring.

FIG. 5 shows schematically and in a partly sectional detail illustration a further design variant according to the invention of a pivotable support means fastening 33*f* with a gas compression spring 40 which comprises a cylinder 41 and a piston rod 42. The spring 40 functions as a force storage element as do the springs 21*d*-21*g*. The piston rod 42 preferably has at the lower end thereof a pivot eye 43*a* in which the support means end connection is preferably fastened to be pivotable. The cylinder 41 similarly optionally has at its upper end a pivot eye 43*b*, which can prove useful in the case of initial mounting or possible demounting for an exchange, but can be subsequently removed in favor of a low constructional height of the support means fastening 33*f*.

The gas compression spring 40 or the support means fastening 33*f* has a force action point KAP which is significantly lower than the force action point of the design variant with helical compression springs. In the case of the latter, it lies at, in particular, the nut which holds the helical compression spring at the upper end (see the nuts 27*a*-27*c* at the tie rods 18*d*-18*f* in FIG. 3*a*).

The cylinder 41 is supported on a support surface 30*b* at or around a bore 24*h* of a rollable body 31*f*. The rollable body 31*f* can optionally also be formed directly integrally with the cylinder 41 and has a rollable body rolling surface 36*d* which in the previously disclosed manner is rollable on a flat rolling surface 34*e* of a mounting plate 20*i*.

The mounting plate 20*i* preferably has a bore 24*g* consisting of several stepped and concentrically arranged individual bores. This form of bore ensures a wide capability of pivotation of the piston rod 42 with optimum material strength of the mounting plate 20*i* in the region around the bore 24*g*. As already mentioned, the bore 24*g* can also be formed as a slot which corresponds in its longitudinal direction with the deflection direction of the piston rod 42.

Moreover, this design variant comprises two abutments 39*a* and 39*b* at the rollable body 31*f*, which block deflection of the support means fastening 33*f* beyond a specific angle. These abutments 39*a* and 39*b* can also be combined with all previously depicted design variants of rollable bodies 31.

Figure 6:
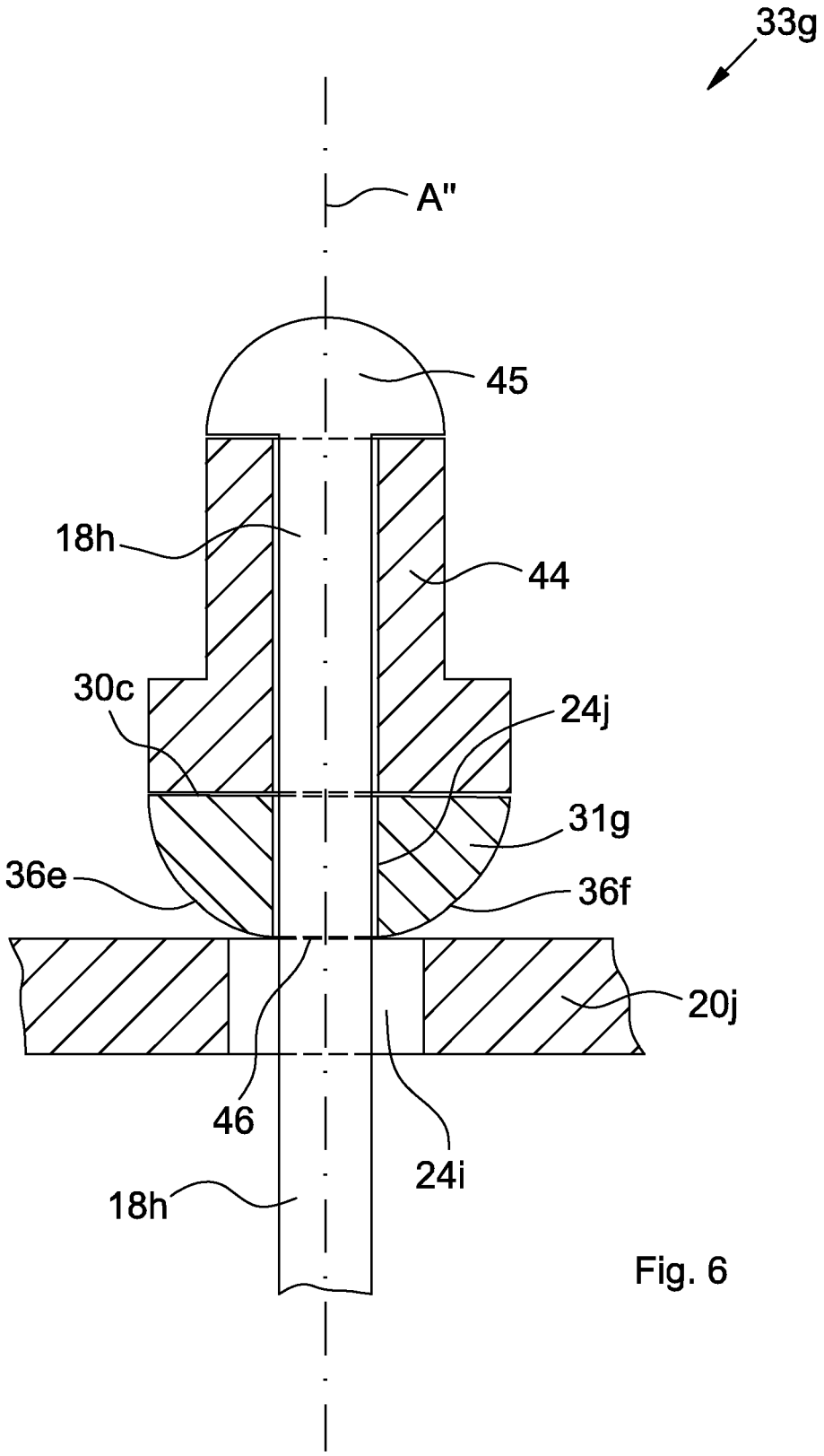
FIG. 6 shows a schematic illustration of a further design variant of a pivotable support means fastening according to the invention with a support sleeve instead of a force storage element.

A further design variant of a pivotable support means fastening 33*g* according to the invention is shown in FIG. 6 schematically and in partially sectioned detail illustration. A tie rod 18*h* is led through a bore 24*i* in a mounting plate 20*j*, wherein the bore 24*i* is here shaped in the form of a slot, the longitudinal direction of which corresponds with the deflection of the tie rod 18*h*, which in turn corresponds with the drawing plane in the illustrated figure. By contrast to the previously illustrated central bores the slot 24*i* on the one hand gives an increased pivot angle, but on the other hand yet a further advantage: there are no longer edges of a (round, central) bore which could mutually hook with the edges of a bore 24*j* in the rollable body 31*g*, because the slot 24*i* forms two webs, of which in the illustrated sectional illustration only a rear web 46 is visible, which intersects an axis A" of the tie rod 18*h*.

The tie rod 18*h* can, as illustrated in FIG. 3*a*, be fastened to a thread of the tie rod by nuts. As shown in this FIG. 6, the tie rod can, however, also form a tie rod head 45 by which it holds a support sleeve 44 which in turn is supported on a support surface 30*c* of a rollable body 31*g*. The support sleeve 44 can consist of a rigid material or, however, can also be made of a defined and preferably only slightly flexible material.

As already mentioned, however, a further variant of embodiment according to the invention is also conceivable in which the tie rod head 45 is supported directly on the support surface 30*c* of the rollable body 31*g* or even a more developed design variant in which the tie rod head 45 directly forms rollable body rolling surfaces 36*e* and 36*f*.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A support fastening for a plurality of supports in an elevator installation, wherein each support of the plurality of supports is connected with a respective associated tie rods of a plurality of tie rods by a respective end connection, the support fastening comprising:

a rollable body supporting all of the respective associated tie rods; and a mounting plate carrying said rollable body wherein the support fastening is adaptable to deflections of the plurality of supports in correspondence with a deflection angle, wherein said rollable body rolls on a flat rolling surface of sold mounting plate in dependence on the deflection angle.

2. The support fastening according to claim 1 including a force storage element arranged at the respective associated tie rods and acting on said rollable body.

3. The support fastening according to claim 2 wherein said force storage element is a gas compression spring with a cylinder and a piston rods and said piston rod functions as said respective associated tie rod and is connected with the end connection.

4. The support fastening according to claim 3 wherein said piston rod has a pivot eye and the end connection is pivotably arranged in said pivot eye.

5. The support fastening according to claim 3 wherein said rollable body is integrated in said cylinder.

6. The support fastening according to claim 1 wherein said mounting plate has a conical bore through which the respective associated tie rods are led.

7. The support fastening according to claim 1 wherein said mounting plate has a bore formed therein with at least two stepped and concentrically arranged individual bores with different diameters and the respective associated tie rods are led through the bore.

8. The support fastening according to claim 1 wherein said mounting plate has a bore formed as a slot through which the respective associated tie rods are led.

9. The support fastening according to claim 1 wherein said rollable body is rollable by a curved rolling surface formed on said rollable body.

10. The support fastening according to claim 9 wherein said rollable body rolling surface and said mounting plate rolling surface are formed with interengaging toothing.

11. The support fastening according to claim 9 wherein said rollable body rolling surface has a sectional profile corresponding with a parabola according to an equation $f(x)=a\,x^n$, wherein at least one of $0<a<1$ and n is an even number.

12. The support fastening according to claim 9 wherein said rollable body rolling surface has a sectional profile with a central section having a radius greater than radii of two sections flanking the central section.

13. The support fastening according to claim 9 wherein said rollable body rolling surface has at least two abutments formed adjacent thereto.

14. The support fastening according to claim 1 wherein the support fastening is adapted to be arranged at any of a stationary fastening point in an elevator shaft, an elevator car and a counterweight.

15. The support fastening according to claim 1, further comprising a plurality of parallel support means, where each support means is coupled to a respective associated tie rods.

16. A support fastening for a plurality of supports in an elevator installation, wherein each support, of the plurality of supports is connected with a respective associated tie rods of a plurality of tie rods by a respective end connection, the support fastening comprising:

a rollable body supporting all of the respective associated tie rods and having a curved rolling surface formed on said rollable body; and a mounting plate carrying said rollable body wherein the support fastening is adaptable to deflections of the plurality of supports in correspondence with a deflection angle, wherein said curved rolling surface of said rollable body rolls on a flat rolling surface of said mounting plate in dependence on the deflection angle.

17. The support fastening according to claim 16 wherein said rollable body rolling surface has a sectional profile corresponding with a parabola according to an equation $f(x)=a\,x^n$, wherein at least one of $0<a<1$ and n is an even number.

18. The support fastening according to claim 16 wherein said rollable body rolling surface has a sectional profile with a central section having a radius greater than radii of two sections flanking the central section.

19. The support fastening according to claim 16 wherein said rollable body rolling surface has at least two abutments formed adjacent thereto.

20. The support fastening according to claim 16, further comprising a plurality of parallel support means, where each support means is coupled to a respective associated tie rods.

* * * * *